United States Patent [19]

Holmgren

[11] 4,445,018

[45] Apr. 24, 1984

[54] ENERGY EFFICIENT FLOATING HEAD PUFFER INTERRUPTER

[75] Inventor: Nils V. Holmgren, Greendale, Wis.

[73] Assignee: McGraw-Edison Company, Rolling Meadows, Ill.

[21] Appl. No.: 337,907

[22] Filed: Jan. 7, 1982

[51] Int. Cl.[3] ..... H01H 33/88

[52] U.S. Cl. ..... 200/148 A

[58] Field of Search ..... 200/148 A

[56] References Cited

U.S. PATENT DOCUMENTS

| | | | |
|---|---|---|---|
| 3,985,988 | 10/1976 | Korner et al. | 200/148 A |
| 3,987,261 | 10/1976 | McConnell | 200/148 A |
| 3,991,292 | 11/1976 | Perkins | 200/148 A |

*Primary Examiner*—Robert S. Macon

*Attorney, Agent, or Firm*—Jon C. Gealow; James A. Gabala; Hugh Gilroy

[57] ABSTRACT

A unique, energy efficient puffer interrupter having a puffer piston and an opposed floating piston or head is described in detail. In one embodiment, the puffer interrupter is formed from a pair of electrical contacts which are disposed within a chamber filled with an arc extinguishing fluid. A prime mover or switching means is used to open and close the switch by moving one of the contacts with respect to the other. A puffer piston is disposed at one end of a cylinder surrounding the fixed contact. A floating piston is disposed at the opposite end of the cylinder and biased towards the moving contact assembly and away from the puffer piston. The puffer piston and the floating piston and the cylinder define a pressurization chamber, which is in fluid communication with the gap defined by the switch contacts. A pressurizing valve means controls the flow of gas from between the two pistons and into the gap thereformed when the switch is opened. A time sequencing means opens the switch contacts after sufficient pressure has been developed to extinguish the arc formed between the contacts. Another sequencing means controls the movement of the floating piston so as to minimize the peak pressure formed in the volume between the two pistons as the contacts are opened and the arc is extinguished. By minimizing the pressure overshoot and by moderating the pressure to a more constant value, the power required to operate the device is consumed more uniformly over that of one having only one moving piston.

16 Claims, 8 Drawing Figures

ENERGY EFFICIENT FLOATING HEAD PUFFER INTERRUPTER

TECHNICAL FIELD

This invention relates to the general subject of circuit breakers and is more particuarly concerned with circuit breakers utilizing a pressurized gas to extinguish the arc formed between two electrical contacts as they are separated.

BACKGROUND OF THE INVENTION

Generally speaking, puffer interrupters do not have the interrupting capacity of a multi-pressure circuit breaker (sometimes called a "double pressure interrupter"). In large part this is due to their inherent limitations. In a multi-pressure circuit breaker, a gas having a strong arc extinguishing capability (such as sulfur hexaflouride $SF_6$) is continuously stored at high pressure. The pressure is released or valved out to the circuit breaker contacts only when interruption is to occur. Since the gas is stored at high pressure for use at a later time, a compressive means or gas compressor having a relatively low flow or compression rate can be used to prepare the device for operation. Accordingly, ample gas is available for interruption and arc extinguishing is good. However, with this type of circuit interrupter, the pressure generating apparatus is relatively complicated and the overall interrupter is relatively large in size; moreover, maintenance has often proved to be a problem. One such interrupter is illustrated in U.S. Pat. No. 2,783,338 issued to Beatty.

In contrast, a puffer interrupter (sometimes called a "single pressure puffer interrupter") does not store the extinguishing gas in a high pressure condition. Instead, a compressive mechanism, typically a piston and cylinder arrangement, is used to compress the gas to the required pressure just prior to circuit interruption. Fischer (U.S. Pat. No. 3,406,296) describes a typical device. Accordingly, a relatively large amount of energy is required to pressurize the gas to the required pressure and at a sufficiently high rate to perform the interruption within the time available. To minimize the loss of pressure or pressure drop after the gas is compressed, the compressive mechanism is located as close as possible to the arc site. Often, the piston used to compress the gas is moved by the same mechanism which moves one of the contacts across which the arc is drawn. From an efficiency standpoint, it is desirable that the smallest amount of gas should be pressurized to the minimum required pressure within the shortest time available. If more gas is compressed than is needed, or if the gas is pressurized to a higher pressure than what is necessary, the prime mover or mechanism used to operate the circuit breaker is not designed in the most efficient manner.

When a multi-pressure circuit breaker is used, it is relatively easy to stage the stored high pressure gas or to compress the gas to the minimum value necessary to achieve interruption. In a puffer interrupter, on the other hand, it is not easy to pressurize the gas to the required minimum pressure or to maintain this pressure at the desired minimum without achieving some overshoot. Any amount of overshoot is wasted work as far as the prime mover is concerned.

There is also an optimum minimum arc length which must be achieved for interruption. As current zero is approached, the arc attempts to track the instantaneous current requirements of the electrical circuit that is joined to the interrupter. The arc lags thermally because it has more thermal energy and conductants that are necessary to meet the instantaneous current requirements. Ideally, an open interrupter presents an infinite impedance to the circuit and prevents current flow. The real interrupter, on the other hand, presents a finite resistance to the rising recovery voltage being impressed across its terminals. The recovery voltage represents stored energy in the circuit and supplies current to the residual conductivity of the arc. A race thus develops in which the interrupter tries to deionize the arc (by the flow of gas) while energy is being replaced in the form of heat (as a result of $I^2R$ losses in the arc). If the power input exceeds the power that the interrupter can remove from the arc, the arc regains its conductivity and causes what is known as "thermal failure." Should the arc deionize, the current will decrease and finally extinguish. Another race develops but, instead of a thermal race of energy balances, it is a race between the interrupter recovering its dielectric strength faster than the recovery voltage can rise. Even though the current is out, for all practical purposes, the residual plasma is still very hot and has not achieved its full dielectric strength. $SF_6$ gas, when used as the arc extinguishing agent, rapidly recovers its dielectric strength and prevents the flow of charged particles necessary for breakdown or "restrike."

In summary, the arc becomes ionized due to the heat supplied from the circuit. The arc must be cooled very rapidly as current zero is approached if the space occupied by the arc is to become a high-resistant insulator. Moreover, if the arc is to remain deionized, the interrupter must remove more energy from the arc than is supplied from the recovery circuit following current zero. Thus, if the arc is too short or too long, the interrupter will either generate, respectfully, excess arc energy or excess dielectric stress.

Puffer interrupters, for the most part, are designed such that the arc is drawn down into a nozzle-like contact into a probe-like protrusion (See Kucharski, U.S. Pat. No. 3,946,180). An efficient design allows the arc to achieve near optimum length in a very short period of time, much as that found in multi-pressure circuit breakers. Milianowicz (U.S. Pat. No. 3,331,935) teaches several embodiments of a gas blast circuit breaker having a dual piston arrangement to provide a so-called "double-acting" puffer interrupter. Simply stated, two pistons are driven towards each other to maximize the rate of gas compression. One of the pistons is driven home by a cocked spring. Yoshioka (U.S. Pat. No. 3,745,281) is similar to Milianowicz. Yoshioka uses an electro-magnetic force generated between a primary coil, which is fixed to the operating rod which moves one of the contact elements, and a ring fixed to a slideably supported puffer piston.

It is also common in the design of conventional puffer interrupters to produce an arc before the nozzle, where interruption is to take place, is physically opened to allow the flow of interrupting gas (for example U.S. Pat. No. 3,941,963 issued to Sasaki). McConnell (U.S. Pat. No. 3,914,569) disclosed a puffer interrupter having a moving assembly connected to the nozzle of the puffer interrupter that is extended and contracted in response to the stroking of one piston and having a second piston-like surface formed in the cylindrical body of the puffer interrupter to control the location at which arcing occurs. In accordance with that invention, a moveable contact and a moveable nozzle are connected to each other such that the moveable contact is repositioned downstream the nozzle throat at the time an arc is drawn between the two contacts. While contamination of the nozzle throat is reduced, the total energy release of the gas blast, especially during the early part of the opening stroke, is also reduced where, of course, interruption cannot be affected.

Kramer (U.S. Pat. No. 3,671,698) uses a moveable contact member carrying a dual piston structure to dampen the opening movement of the moveable contact as well as the closing movement. It functions much as an ordinary dash pot. Körner (U.S. Pat. No. 3,985,988) disclosed one embodiment of a circuit breaker assembly having a pair of contact elements, one of which is displaced by the pressure occurring within the quenching chamber surrounding the arc which is stuck upon separation of the contact elements. Roston (U.S. Pat. No. 3,987,262) teaches a puffer interrupter having a composite piston structure which is retracted during operation of the interrupter. The result is the production of higher pressures early in the stroke of the puffer piston. Milianowicz (U.S. Pat. No. 3,331,935) is similar with the exception that two opposed puffer pistons are used. It is also common in many puffer interrupters to initiate gas flow before the interrupter is capable of performing interruption. That is, the gas is emmited too soon. This is wasteful and ultimately requires that the prime mover compresses more gas than what is actually required under optimum conditions.

In summary, since the gas must be compressed prior to interruption, it should be clear that successful interruption cannot take place prior to the time that the gas is compressed to the required minimum pressure. It is also fundamental that a smaller volume of gas can be compressed to the required minimum pressure sooner and much more easier than a larger volume of gas. Finally, if the pressure produced across the arc is greater than what is required towards the end of the arc extinguishing cycle, when the arc is almost extinguished, then the excess pressure produced is equally wasteful and indictive of using the prime mover at less than optimum efficiency. A puffer interrupter that is designed to incorporate these fundamental considerations would go far towards achieving the interrupting efficiency heretofore experienced by multi-pressure circuit interrupters.

SUMMARY OF THE INVENTION

In accordance with the present invention, a circuit interrupter of the puffer variety is described utilizing a novel floating piston or head which cooperates with an oppositely disposed reciprocating pressurizing puffer piston to form a pressurizing chamber, the internal pressure of which is maintained relatively uniform during the entire opening cycle of the interrupter. More specifically, the circuit interrupter comprises a pressure chamber, a switching means, an electrical switch, a pressurizing means, and a pressure control means. The pressure chamber carries a set of electrical contacts which together form the switch. One of the contacts is movable between an open and a shut position in response to the switching means or prime mover. The pressurizing means is also operated by the switching means and serves to discharge an arc extinguishing fluid, such as sulfur hexafluoride—$SF_6$, into the gap formed between the switch contacts when the switch is opened. The pressure control means maintains a substantially uniform pressure differential across the switch contacts while the switch is being opened by the switching means.

In one embodiment, the electrical contacts are formed from a pair of tubular nozzle-like contact members which extend from opposite ends of a generally cylindrical housing. Mounted within the tubular contacts are a pair of arcing probes which are spaced axially apart from each other when the tubular contacts are in an abutting relationship. When the device is actuated, the puffer piston, at one end of the housing, is driven toward the opposite end, thereby producing a volume of pressurized fluid. When the pressure is sufficiently great, the two tubular contacts are driven apart by a prime mover, thereby producing an arc over which the compressed gas or fluid is allowed to flow. As the tubular contacts are drawn further apart, the arc is transferred to the central internal arcing probes. Another piston is disposed at the opposite end of the housing within a cylinder, the length of which is less than the stroke of the moving tubular contact. This piston is biased away from the puffer piston, toward the opposite end of the housing and against the free end of the moving tubular contact. Thus, the piston is displaced in response to the operation of the moving tubular contact. A lost motion assembly allows the piston to move away from the puffer piston before the two contact members separate once the puffer piston starts moving. Effectively, the piston "floats" between the moving contact and the puffer piston and has a stroke intermediate the stroke of the moving tubular contact. Thus, the volume formed between the two pistons in the housing varies or changes depending upon the relative position of the pistons, which in turn is dependent upon the relative position of the two tubular contacts.

Specifically, during the early part of the opening cycle of the interrupter, the floating piston is located relatively close to the puffer piston. During this time, the pressure rises faster as the function of the stroke of the puffer piston than it would if the floating piston were farther away or if the cylindrical volume between the two pistons was larger. Later, during the stroke of the puffer piston, the floating piston is free to move away from the puffer piston. This effectively increases the volume of the cylinder between the two pistons and reduces the pressure peak which would ordinarily occur had the floating piston remained fixed in position. This pressure peak is normally experienced during the operation of ordinary puffer interrupters and is the result of prime mover overshoot as well as the increase in enthalpy of the gas due to the energy input of the arc. Thus, the pressure produced within the device rises faster in the earlier part of the cycle and remains at a relatively high value through latter portions of the cycle. In other words, the pressure across the switch contacts is more uniform throughout the cycle. Since the energy required to operate the puffer piston is proportional to the load imposed on the prime mover by the puffer piston, energy is more uniformly consumed by the prime mover and the prime mover is more effectively utilized.

Numerous other advantages and features of the present invention will become readily apparent from the following detailed description of the invention and its various embodiments, from the claims, and from the accompanying drawings.

DETAILED DESCRIPTION OF THE PREFERRED EMBODIMENTS

Figure 1A:
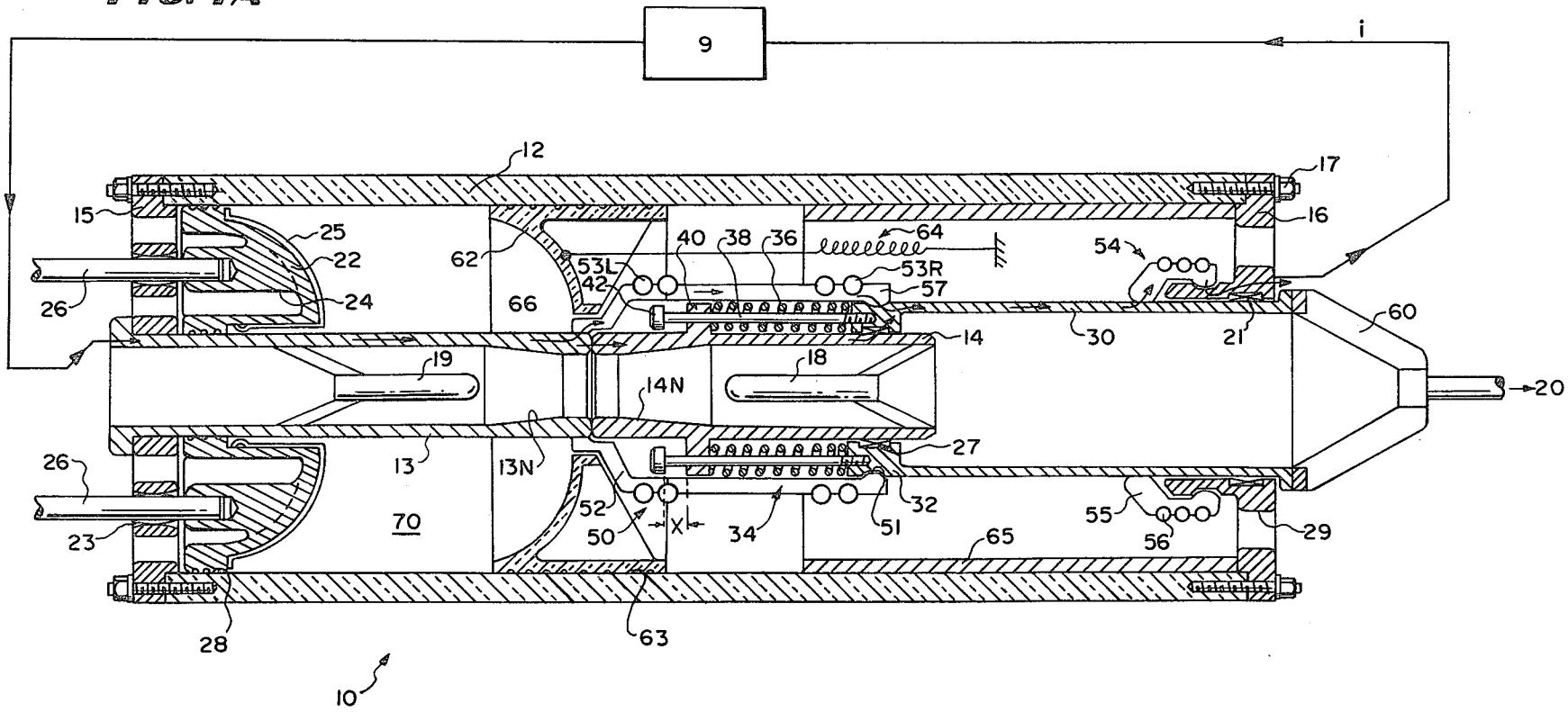
FIG. 1A is a cross-sectional, elevational view of the interrupter, which is the subject of the present invention, with the interrupter contacts closed.

While this invention is susceptable of embodiment in many different forms, there is shown in the drawings, which will herein be described in detail, several preferred embodiments of the invention. It should be understood, however, that the present disclosure is to be considered as an exemplification of the principles of the invention and is not intended to limit the invention to the specific embodiments illustrated. First, the major components of the invention will be described in detail and then the integrated operation of these components will be explained.

MAJOR COMPONENTS

Turning to the drawings, FIG. 1A illustrates a puffer interrupter 10 that is the subject of the present invention. In particular, the puffer interrupter 10 is mounted in a cylindrical housing 12 which carries a pair of coaxial tubular contacts 13 and 14; the two abutting open ends carry Laval flow nozzles 13N and 14N. These contacts are aligned within the cylindrical housing 12 by a pair of end mounted locator guide rings 15 and 16. As illustrated in the drawings, the guide rings 15 and 16 are joined to the ends of the cylindrical housing 12 by threaded fasteners 17. Since threaded fasteners are easily disconnected, maintenance and repair of the puffer interrupter 10 is facilitated. The housing 12 is located within a tank (not shown for purposes of clarity) which is filled with an arc extinguishing gas, such as Sulfur Hexafluoride—$SF_6$, that disassociates in the presence of an electrical arc.

Since $SF_6$ is most effective when it is forced to flow coaxially over an arc which is axially positioned within a set of Laval nozzles, a pair of arcing probes 18 and 19 are mounted within the two tubular contacts 13 and 14. Each arcing probe is located at a spaced distance away from the open nozzle end of the tubular contact in which it is housed. One contact tube 13 is fixed in position. The other contact tube 14 is free to move towards and away from the nozzle end of the fixed tubular contact 13 through the operation of a switching mechanism or prime mover 20. When interruption is to occur, the prime mover 20 draws the two nozzled ends of the two tubular contacts 13 and 14 axially apart. The exact sequence of this operation will be described in detail at a later point in this discussion. The two tubular contacts 13 and 14 are electrically connected to the circuit (not shown) which is to be interrupted.

A generally semi-hemispherical puffer piston 22 is disposed adjacent the guide ring 15 which carries the fixed tubular contact 13. The periphery of the puffer piston 22 forms a pressure seal with the inside of the housing 12; in FIG. 1A a series of O-rings or piston rings 28 are used to form this pressure seal. Lighting voids 24 in the puffer piston 22 are preferably used to reduce the overall mass of the piston and the load on the prime mover. As will become apparent from a subsequent discussion, the spherical shape of the puffer piston 22 facilitates channeling compressed gases into the arc formed between the two tubular contacts 13 and 14 as they are separated. A shield 25 is provided on the face of the puffer piston 22 to reduce the dielectric stress on the system at current zero. A current exchange (not shown for purposes of clarity) electrically connects one end of the external electrical circuit 9 to the fixed tubular contact 13. Connecting rods 26 are used to drive the puffer piston 22 reciprocatingly within the housing 12. The relationship between the movement of connecting rods 26 and the switching mechanism or prime mover 20 will be described at a later point in this discussion. The connecting rods 26 pass through openings 23 in the guide ring 15.

Turning to the opposite end of the housing 12, a frame 30 is used to join the prime mover 20 to the moving tubular contact 14. The frame 30 carries a circular guide or carrier 32 into which the moving tubular contact 14 is fitted. A bearing 27 allows the moving tubular contact 14 to slide axially within the guide 32. The guide 32 also carries a combination biasing and lost motion assembly 34, the purpose of which is to control the movement of the moving tubular contact 14 relative to the movement or stroking of the prime mover 20 and frame 30.

Figure 1B:
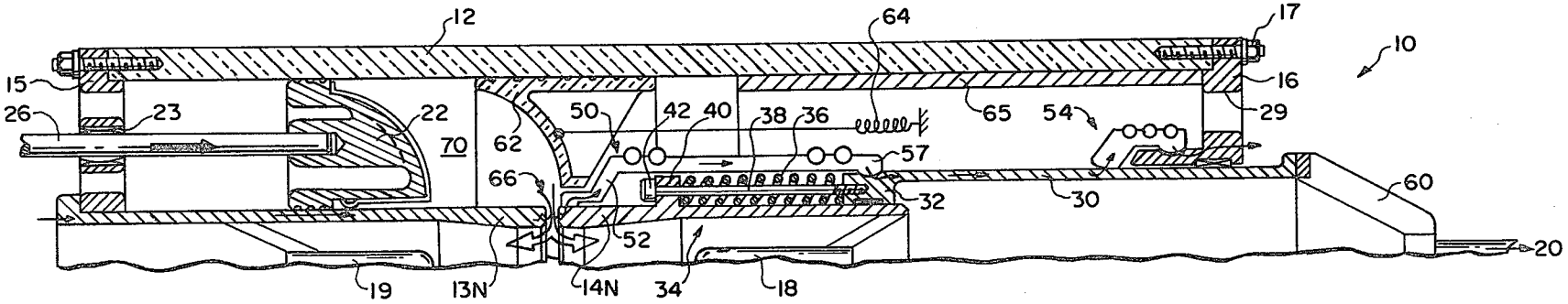
FIGS. 1B through 1E are partial, cross-sectional side elevational views of the interrupter shown in FIG. 1A illustrating the relative positions of the internal parts as the interrupter contacts are moved from their closed position to their opened position.

The biasing and lost motion assembly 34 includes a plurality of compression springs 36 and associated retaining or pusher pins 38. One end of each pusher pin 38 is threadably connected to the guide 32. The other end of each pusher pin 38 is disposed toward the fixed tubular contact 13 and passes through a collar 40 which is integrally connected to the exterior of moving tubular contact 14. The compression springs 36 are disposed around each pusher pin 38 between the collar 40 and the guide 32. The length of the pusher pins 38 is greater than the relaxed length of the compression springs 36. In particular, the free end of the pusher pin contains a stop or head portion 42, the center of which is located at a spaced distance X from the collar 40 when the interrupter 10 is closed. Thus, when the interrupter 10 is open the compression springs 36 force the collar 40 against the head 42 at the free end of the pusher pin 38. Accordingly, when the moving tubular contact 14 is forced into an abutting relationship with the fixed tubular contact 13 (i.e. the interrupter 10 is closed), the collar 40 compresses the springs 36 against the guide 32. This insures that the two tubular contacts 13 and 14 are firmly held together when the interrupter 10 is closed (FIG. 1A). However, when the prime mover 20 draws the frame 30 away from the fixed tubular contact 13 (see FIG. 1B), the moving tubular contact 14 remains in an abutting relationship with the fixed tubular contact until the prime mover has moved the frame through a distance greater than the distance X between the head portion 42 and the collar 40 when the interrupter 10 was closed. Once the head portion 42 comes in contact with the collar 40, the moving tubular contact 14 moves in unison with the frame 30 (see FIGS. 1C through 1E).

The guide 32 also carries a moving contact assembly 50. This contact assembly 50 carries a plurality of main contactors or fingers 52 which are clustered around the free or nozzled end of the moving tubular contact 14. Each finger 52 extends beyond the free end of the moving tubular contact 14 so as to mate with the free or nozzled end of the fixed tubular contact 13 when the interrupter 10 is closed. Each finger 52 is generally Z-shaped. One leg of each finger (i.e. the right end using the orientation of FIG. 1A) carries a integral fulcrum or inwardly directed protrusion 57 which rests within a circumferential groove 51 at the free end (i.e. left-hand end using the orientation of FIG. 1A) of the frame 30. A plurality of garter springs 53R and 53L hold the fingers biased inwardly towards the outside periphery of the nozzled end of the moving tubular contact 14. The opposite leg of each finger 52 (i.e. left-hand end) makes contact with the free end of the fixed tubular contact 13 without contacting the free end of the moving tubular contact 14 when the two tubular contacts 13 and 14 are in an abutting relationship (i.e. the interrupter 10 is closed). This insures that the current passing through the interrupter 10 when the interrupter is closed (see FIG. 1A) flows through the fingers 52 and through the moving frame 30 without having to use the more resistive path through the bearing 27.

The fixed guide ring 16 for the moving tubular contact 14 carries a bearing assembly and a current interchange 54. The current interchange 54 includes a plurality of sliding contactors 55 which are biased inwardly towards the traveling frame 30 by a plurality of garter springs 56. The current interchange 54 electrically connects the current flowing from and through the moving tubular contact 14 and the frame 30 to the other side of the external electrical circuit 9 joined to the interrupter 10. The fixed guide ring 16 is provided with a plurality of apertures 29 which are sufficiently large so as not to inhibit the flow of gas moving through the housing 12. Thus, when the interrupter 10 is in the closed or shut position (as shown in FIG. 1A) the current passing through the interrupter flows for the most part from the fixed tubular contact 13 through the fingers 52, to the moving frame 30, and to the current interchange 54 carried by the fixed guide 16.

A spider 60 is used to join the prime mover 20 to the right-hand end of the sliding frame 30. The spider 60 allows gases flowing through the moving tubular contact 14 and across the arcing probe 18 to flow freely out of the housing 12.

Another piston, hereinafter called the "floating piston" 62, is disposed co-axially around the two tubular contacts 13 and 14 and within the cylindrical housing 12. As shown in FIG. 1A, the floating piston 62 is generally hemispherical in shape and is complementary to the domed puffer piston 22. A plurality of seal rings 63 provides a pressure seal between the interior of the cylindrical housing 12 and the exterior of the floating piston 62. Relative to the puffer piston 22, the floating piston 62 acts as the "head" of the cylindrical chamber formed between these two pistons and the housing 12.

The floating piston 62 is biased by one or more extension springs 64 (shown schematically for descriptive purposes) away from the free or nozzled end of the fixed tubular contact 13 and towards the right-hand end of the housing 12. The floating piston 62 defines a central opening or aperture 66 through which the moving and fixed tubular contacts 14 and 13 are free to come together. When the interrupter 10 is closed, the edges of the floating piston 62 bordering the aperture 66, together with the outside surface of the fixed tubular contact 13 define an annular opening sufficiently large to permit the rightward movement of the free end of each finger 52 of the moving contact assembly 50 to come into engagement with the free end of fixed tubular contact 13. However, the annular opening is sufficiently small that the floating piston 62 cannot pass over or across the moving contact assembly 50 much beyond the free end of each contact finger 52. Thus, the moving tubular contact 14 limits the travel of the floating piston 62. Irrespective of the position of the moving tubular contact 14, the floating piston 62 is limited in its rightward travel by an inner sleeve or stop sleeve 65. The stop sleeve 65 is disposed at the interior of the cylindrical housing 12 in an abutting relationship with the right-hand fixed guide ring 16. Thus, in the absence of the force provided by the moving tubular contact 14 to oppose the extension springs 64, the floating piston 62 will be disposed against the innermost end (i.e. left-hand end) of the stop sleeve 65.

OPERATION

Figure 3A:
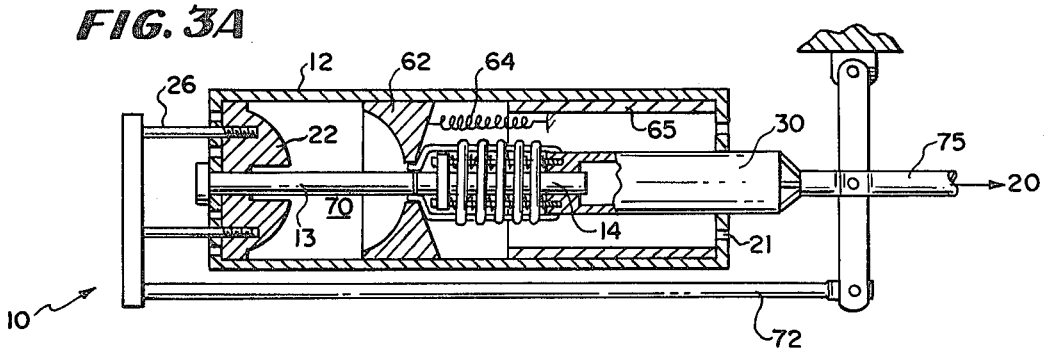
FIGS. 3A and 3B are partial exterior views of two embodiments of the mechanism used to operate the interrupter pistons shown in FIG. 1A.

Now that the principal components of the invention have been described in detail, the overall operation of the puffer interrupter 10 will be described. When the puffer interrupter 10 is in its normal or closed position (FIG. 1A), the pressure of the fluid within the various regions and zones of the device are all equal. When a fault condition occurs and the current passing to the external circuit 9 is to be interrupted, the puffer piston 22 is driven by the prime mover 20 (see FIG. 3A) towards the floating piston 62. This compresses the gas within the volume or space 70 between the two pistons 22 and 62. From examination of the linkage 72 shown in FIG. 3A, it should be clear that the motion of the puffer piston 22 is independent of, but generally synchronized with, the motion of the moving tubular contact 14 so that the puffer piston moves before the moving tubular contact.

Figure 3B:
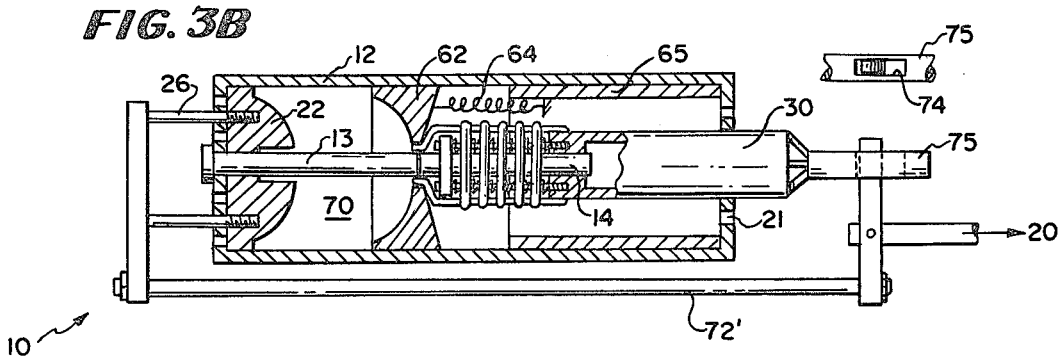

Other linkages and mechanisms may be used to produce the same effect. For example, in FIG. 3B the puffer piston 22 is directly connected to the prime mover 20 using a rigid link 72'. A slot 74 in the drive shaft 75 delays the stroke of the moving frame 30 until after the puffer piston 22 has began its compression stroke. Returning to the mechanism shown in FIG. 3A, when the pressure within the volume or space 70 between the two pistons 22 and 62 has been raised to a state sufficient to obtain an arc interruption, the moving frame 30 is also driven to the right (see FIG. 1B) and away from the fixed tubular contact 13. The rightward movement of the prime mover 20 drives the frame 30 and the head 42 of the pusher pins 38 to the right while the moving tubular contact 14 is held in an abutting relationship with the fixed tubular contact 13 by the compression springs 36. As the moving frame 30 continues to move to the right, the free end of each finger 52 slides free from the free end of the fixed tubular contact 13 and along the free end of the moving tubular contact 14.

Figure 1C:
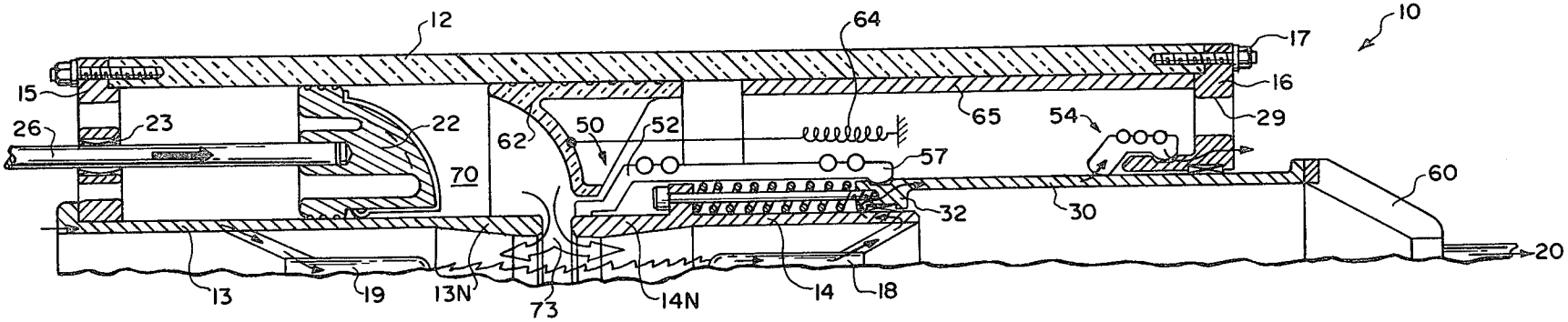

After the head 42 of the pusher pins 38 comes into contact with the collar 40 of the moving tubular contact 14, the moving tubular contact is also driven to the right by the prime mover 20 (see FIG. 1C). This separates the free end of the fixed tubular contact 13 from the free end of the moving tubular contact 14 which allows the gas compressed within the volume 70 between the puffer piston 22 and the floating piston 62 to flow towards the interior of the two tubular contacts and through the the two Laval nozzles 13N and 14N. As the contact fingers 52 are forced to the right, the floating head extension spring 64 and the pressure within the volume 70, maintains the position of the floating head 62 sychronized with the position of the moving frame 30.

Figure 1D:
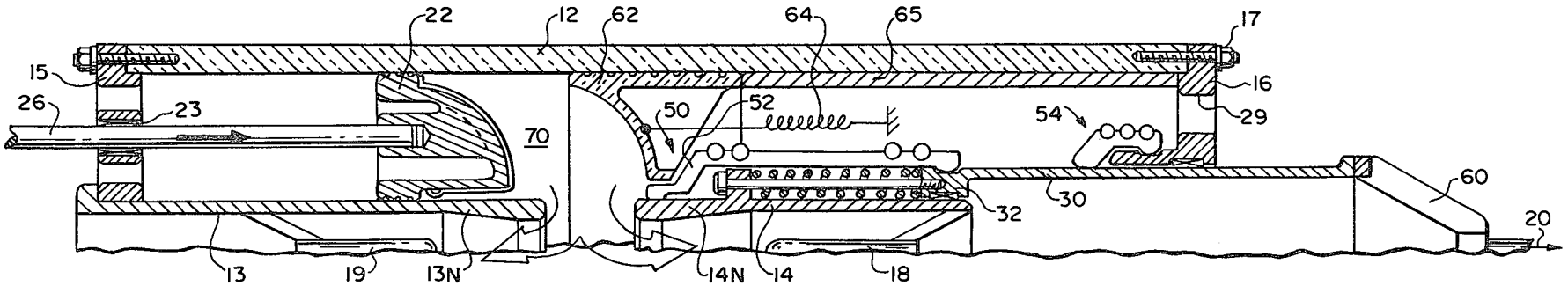

Once the moving tubular contact 14 and the fixed tubular contact 13 separate, an arc is formed. Further parting of the two contact faces produces gas flow and magnetic forces which quickly transfer the arc 73 into the interior of the fixed tubular contact 13 and the moving tubular contact 14 thereby drawing the arc between the two arcing probes 18 and 19 (see FIG. 1C). When current zero occurs, the arc will be extinguished causing current flow to cease. This is illustrated in FIG. 1D. It should be noted that the puffer piston 22 is shown at rest in FIGS. 1A and 1E while the floating piston 62 is moving in FIGS. 1B and 1C.

Figure 1E:
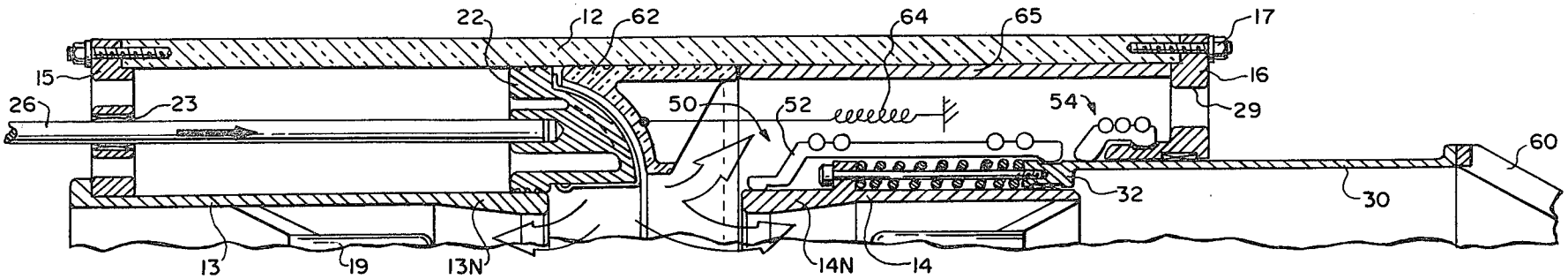

Eventually, the floating piston 62 will come into contact with the inner sleeve 65. This restricts further motion of the floating piston 62 while the moving frame 30 is driven further to the right. Once the floating piston 62 is stopped against the inner sleeve 65, the continued rightward motion of the moving tubular contact 14 carries each contact finger 52 out of the annular space defined by the exterior of the moving tubular contact and edges of the floating piston bordering the center aperture 66 of the floating piston 62. This allows gas to enter into the volume or space between the cylindrical housing 12 and the exterior of moving tubular contact 14. Continued travel of the moving tubular contact 14 and the puffer piston 22 is illustrated in FIG. 1E. Once the puffer piston 22 comes into contact with the floating piston 62 gas flow ceases.

Figure 2:
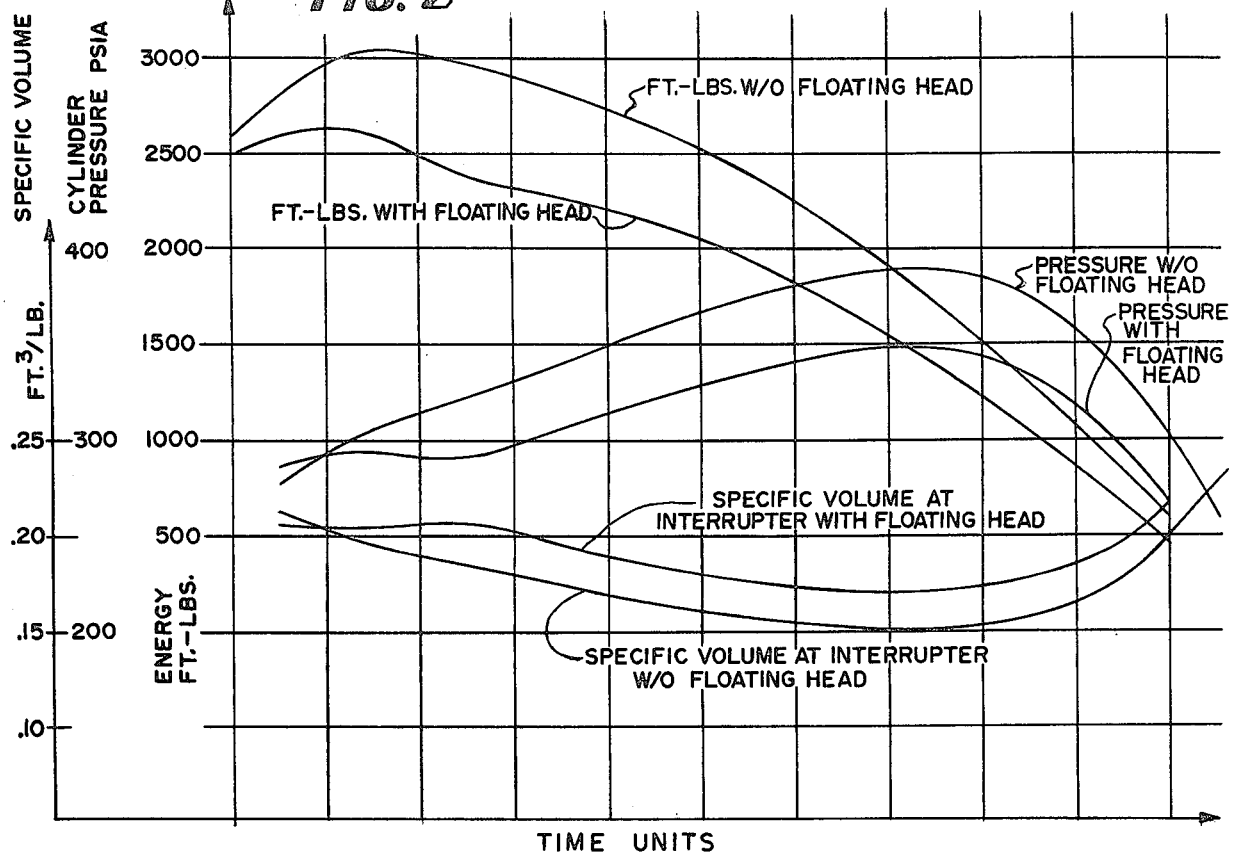
FIG. 2 is a graph illustrating the variation over time of pressure, volume and energy associated with the operation of the interrupter shown in FIGS. 1A through 1E.

The advantages of the operation just described are particularly evident from a consideration of the graph shown in FIG. 2. The data used in FIG. 2 resulted from a study of two interrupters. The two interrupters were otherwise identical in that piston displacement as a function of time, contact displacement as a function of time, nozzle area, puffer piston area, puffer piston stroke, etc., and location of the head at the end of the stroke were identical. The only variable or difference was that in one case the head was allowed to move, initially being displaced to reduce the cylinder volume, and subsequently being allowed to move and effectively decrease the cylinder volume at a controlled rate. The graph clearly demonstrates that by controlling the movement of the head (i.e. a floating piston 62 as illustrated in FIGS. 1A through 1E), gas pressure is raised to the state necessary for interruption earlier; less energy is required to pressurize the gas to the state required for interruption; and the pressure overshoot (i.e. pressure over that required to achieve interruption) is less. Thus, the puffer interrupter that is the subject of the present invention, has the following advantages and features:

A. The arc extinguishing gas is compressed to the required energy state in a shorter period of time;

B. The contact separation does not occur until the required minimum gas conditions have been achieved;

C. Arc length is optimized in the nozzled contact tubes after the contacts part thereby allowing supersonic expansion of the gas;

D. Interruption occurs while the contacts are in a high density (high dielectric strength) gas;

E. Residual arc products following interruption are scavenged through a double flow path on either side of the main contacts;

F. The excess work or energy required to operate the device over that energy or work required to achieve the minimum pressure condition for gas interruption is minimized; and G. A shielding effect is achieved to reduce the electrical stress on the contacts following interruption.

From the foregoing, it will be observed that numerous variations and modifications may be effected without departing from the true spirit and scope of the novel concept of the invention. For example, in consideration of FIGS. 3A and 3B, it should be clear that there are several mechanisms which can be used to synchronize the operation between the moving contact assembly and the puffer piston. Thus, it should be understood that no limitation with respect to the specific apparatus illustrated herein is intended or should be inferred. It is, of course, intended to cover by the appended claims all such modifications as fall within the scope of the claims.

What is claimed is as follows:

1. A puffer interrupter, comprising:

a. a housing carrying therein a first electrical contact;

b. a pressurization chamber defined by said housing and said first electrical contact and adapted to be filled with an arc extinguishing fluid;

c. a second electrical contact disposed within said housing and free to move into and out of engagement with said first electrical contact so as to form an electrical switch, said contacts defining a switch gap when said switch is open;

d. switching means, operatively connected to said second electrical contact, for opening and closing said switch, said switch contacts drawing an arc there between when said switch is opened with current passing there through;

e. pressurization means, operated by said switching means between a first position and a second position, for pressurizing the fluid within said pressurization chamber and for discharging pressurized fluid from said pressurization chamber into said switch gap when opening said switch, thereby facilitating the extinguishing of the arc thereformed, said first position and said second position defining the stroke of said pressurization means; and f. volume control means, carried within said housing in fluid communication with said pressurization chamber and operated in response to the movement of said second electrical contact, for maintaining the pressure across said switch contacts generally uniform at the beginning of the stroke of said pressurization means and for rapidly releasing the pressure within said pressurization chamber at tne end of said stroke when opening said switch by moderating the rate at which the volume of said pressurization chamber is pressurized as compared to the rate of pressurization which would be achieved by said pressurization means alone, whereby energy is more uniformly expended by said switching means in operating said pressurization means to open said switch.

2. The puffer interrupter set forth in claim 1, wherein said pressurization means includes:

a. a first piston which is moved between a first and a second position within said pressurization chamber in response to said switching means; and b. valve means, carried by said second electrical contact, for releasing fluid into said switch gap when said first piston is intermediate its first and second positions.

3. The puffer interrupter set forth in claim 2, wherein said volume control means includes:

a. a second piston housed within said pressurization chamber and moveable between a closed position and an open position;

b. means for biasing said second piston towards its open position; and c. a positioner, connected to said second electrical contact, for moving said second piston from said open position to said closed position.

4. A circuit interrupter, comprising:

a. a first cylinder which is open at both ends and which is adapted to be filled with an arc extinguishing gas;

b. a pair of electrical contacts including a first electrical contact, which is disposed within and carried by said first cylinder, and including a second electrical contact which is disposed within said first cylinder and which is free to move into and out of engagement with said first electrical contact so as to form an electrical switch;

c. a first piston, disposed reciprocatingly within said first cylinder, said first piston being movable between a first position and a second position;

d. a second piston, disposed reciprocatingly within said first cylinder to move between a third position and a fourth position, said third position and said second position being intermediate said first and said fourth positions, said first piston and second piston and said first cylinder defining a pressurizing chamber which is in fluid communication with the gap defined by said switch contacts when said contacts are disengaged;

e. biasing means, carried by said first cylinder for biasing said second piston to its fourth position;

f. pressurizing means for driving said first piston between its first and second positions, pressure being developed in said pressurizing chamber by driving said first piston toward said second piston;

g. pressurizing valve means, operated in response to the movement of said second electrical contact, for discharging fluid from said pressurizing chamber into said switch gap when said first piston is intermediate said first position and said second position;

h. first time sequencing means, operatively connected to said first piston and said second electrical contact, for closing said switch by moving said second electrical contact into engagement with said first electrical contact, and for opening said switch after said first piston is intermediate its first and second positions, whereby pressure is developed within said pressurizing chamber by stroking said first piston and is not discharged by said pressurizing valve means into the gap between said switch contacts until after an arc is formed between said contacts as said contacts are separated; and i. second time sequencing means, carried by said second electrical contact, for overcoming said biasing means and driving said second piston from its fourth position to its third position when said switch is closed by said first time sequencing means, said second piston being free to move from its third position under the influence of said biasing means after said pressurizing valve means begins to open, whereby the pressure within said pressurizing chamber is controllably released in response to the movement of said second electrical contact and the power required to reposition said first piston and pressurize said fluid is consumed more uniformly than that power consumed if said second piston were fixed in position.

5. The interrupter set forth in claim 4, further including venting valve means, operated in response to the position of said second piston, for venting the pressure developed between said first piston and said second piston when said switch is opened and said second piston is in its fourth position.

6. A gas-blast type circuit interrupter, comprising:

a. a casing for containing an arc extinguishing gas;

b. a pair of separable electrical contact elements coaxially disposed within said casing, at least one of said contact elements being moveable between a closed position and an open position and having a hollow interior open at two ends, an electrical arc being established within said hollow interior after contact separation when current is passing through said contact elements prior to separation;

c. mechanical means, including a puffer chamber disposed within said casing, for pressurizing said arc extinguishing gas before separation of said contact elements, and for moving said one contact element between its closed and open positions;

d. valve means for establishing fluid communication from said puffer chamber to the interior of said one contact element when said contact elements are separated beyond a pre-determined distance from each other during separating movement of said one contact element; and e. pressure control means, disposed within said puffer chamber, for moderating the pressure variations within said puffer chamber as said contact elements are separated.

7. The circuit interrupter as claimed in claim 6, wherein said casing is in the form of an open ended cylinder, and wherein said mechanical means comprises a piston, disposed within said open ended cylinder, for compressing arc extinguishing gas therein, said piston and cylinder defining said puffer chamber.

8. The circuit interrupter as claimed in claim 7, wherein said puffer chamber is defined at one end of said cylinder and said piston is operatively connected to said moving contact element so as to compress the extinguishing gas within said puffer chamber as said contact elements are separated.

9. The circuit interrupter as claimed in claim 7, wherein said piston and cylinder are coaxially disposed around said pair of electrical contact elements.

10. The circuit interrupter as claimed in claim 6, wherein said puffer chamber is co-axially disposed around said pair of electrical contact elements.

11. The circuit interrupter as claimed in claim 6, wherein said one contact element has an orifice at that end adjacent the other contact element, and wherein said one contact element includes an arcing probe disposed at its interior at a spaced distance from said orifice.

12. The current interrupter as claimed in claim 6, wherein said one contact element carries:

a. a sliding contact disposed towards the other contact element and movable between a first position and a second position towards and away from the other contact element; and b. biasing means for biasing said sliding contact towards said first position, said first position lying between the abutting end of the other contact element and said second position when said contact elements are open, said sliding contact being in said second position when said contact elements are forced together in an abutting relationship, whereby said contact elements are forceably maintained together when they are in their closed position.

13. The circuit interrupter as claimed in claim 6, wherein said one contact element includes:

a. a fixed portion;

b. a moving portion, one end of which is carried by said fixed portion with the other end disposed toward said other contact element, said moving portion being free to stroke relative to said fixed portion towards and away from the other contact element when said contact elements are open; and c. biasing means, carried by said fixed portion, for biasing the other end of said moving portion towards said other contact element, whereby said contact elements are forceably held together in an abutting relationship when said contact elements are closed.

14. The circuit interrupter as claimed in claim 13, further including:

a. a contact finger having one end carried by said fixed portion and the opposite end disposed towards the other end of said moving portion; and b. biasing means, carried by said moving portion, for biasing said opposite end towards the other end of said moving portion, said contact finger having a length relative to the stroke of said moving portion such that said opposite end is disposed against the other end of said moving portion when said contact elements are open and disposed against the abutting end of the other contact element when said contact elements are closed, whereby electrical current is free to flow from said one contact element to the other contact element through said contact finger when said contact elements are closed.

15. An interrupter, comprising:

a. a tank-like housing which is adapted to contain an arc extinguishing fluid and defining a generally cylindrical interior tank wall;

b. a pair of tubular, co-axially disposed, separable electrical contact elements carried by said tank, one of said contact elements being movable between a separated position and an abutted position where said contact elements are in an end to end abutting relationship, each of said tubular contact elements having a venturi at its abutting end and an arcing probe centrally disposed therein at a spaced distance from the respective venturi such that an electrical arc is formed between said arcing probes upon separation when current is passed across said contact elements prior to separation and arc extinguishing fluid is forced into each venturi in the direction of said arcing probes;

c. a reciprocating puffer piston co-axially disposed around the other contact element and in sealing relationship with the exterior of said other contact element and said interior tank wall so as to be movable between a first position and a second position;

d. prime mover means for moving said one contact element between its separated and abutting positions and for moving said puffer piston reciprocatingly towards and away from the gap defined by said contact elements when they are separated from each other;

e. a floating piston, co-axially disposed around said one contact element and in a sealing relationship with said interior tank wall so as to be movable between a primary and a secondary position, said primary position lying intermediate the first position of said puffer piston and the separated position of said one contact element, said puffer piston and said floating piston together with said interior tank wall and the exterior of said contact elements defining an annular pressurization chamber when said one contact element is in its abutted position;

f. means, carried by said tank, for biasing said floating piston towards its secondary position;

g. stop means, carried by said one contact element, for driving said floating piston from its secondary position to its primary position, whereby the position of said floating piston is determined by the operation of said prime mover means; and h. delay means, operatively connecting said prime mover means and said one contact element, for delaying the separation of said contact elements until said puffer piston has been moved by said prime mover means to a position intermediate its first and second positions, whereby the fluid within said pressurization chamber is pressurized before said contact elements are separated and the maximum pressure within said pressuriztion chamber is less than the maximum pressure which would be achieved if said floating piston were fixed in position.

16. The interrupter set forth in claim 15, wherein said secondary position of said floating piston is intermediate said abutted and separated positions of said one contact element.

* * * * *